United States Patent [19]

Will

[11] 4,347,429

[45] Aug. 31, 1982

[54] HIGH CAPACITY CORROSION AND EROSION RESISTANT ELECTRODES FOR AC ELECTRODE BOILERS

[75] Inventor: Fritz G. Will, Schenectady, N.Y.

[73] Assignee: General Electric Company, Schenectady, N.Y.

[21] Appl. No.: 52,788

[22] Filed: Jun. 28, 1979

[51] Int. Cl.[3] ..... H05B 3/60; F22B 1/30; C25B 11/04

[52] U.S. Cl. ..... 219/288; 204/291; 204/292; 219/275; 219/292; 338/80; 429/223

[58] Field of Search ..... 219/284–295, 219/271–276; 204/292, 291, 293; 429/223; 338/80–86

[56] References Cited

U.S. PATENT DOCUMENTS

| | | | |
|---|---|---|---|
| 1,337,120 | 4/1920 | Cutler | 219/290 |
| 1,402,751 | 1/1922 | Edison | 429/223 |
| 1,845,852 | 2/1932 | Slisz | 219/295 |
| 1,955,115 | 4/1934 | Drumm | 429/223 X |
| 2,361,378 | 10/1944 | Brennan | 204/292 X |
| 2,634,303 | 4/1953 | Moulton | 429/223 X |
| 3,009,979 | 11/1961 | Corren et al. | 429/223 X |
| 3,121,029 | 2/1964 | Duddy | 429/223 X |
| 3,653,967 | 4/1972 | Beauchamp | 429/223 X |
| 3,926,671 | 12/1975 | Gutjahr et al. | 429/223 X |

*Primary Examiner*—A. Bartis

*Attorney, Agent, or Firm*—Jane M. Binkowski; James C. Davis, Jr.; Joseph T. Cohen

[57] ABSTRACT

An electrode boiler containing an aqueous electrolyte is provided with a pair of spaced electrodes immersed in the electrolyte and connected to an AC power source. Each electrode comprises an electrically conductive metal substrate having adhered to one face thereof a microporous electrochemically active mass comprising a reversible electrode couple covering essentially the entire face and being present in such quantity that at least some of each member of the electrode couple is present at all times during use. The electrodes are arranged with the active masses facing each other and in contact with the electrolyte. The electrode couple consists essentially of a material which is electrochemically reversibly oxidized and reduced in response to alternating current flow therethrough from one electrode to the other; thereby allowing high current density use without promoting corrosion or erosion of the electrodes. Examples of electrode substrate materials and electrode couples usable therewith are nickel and $Ni(OH)_2/NiOOH$, copper and $CuO/Cu(OH)_2$, and lead and $Pb/PbSO_4$.

16 Claims, 9 Drawing Figures

HIGH CAPACITY CORROSION AND EROSION RESISTANT ELECTRODES FOR AC ELECTRODE BOILERS

BACKGROUND OF THE INVENTION

This invention relates to electrodes for electrode boilers, and in particular, to such electrodes having an active material that can undergo reversible oxidation and reduction deposited on the electrode surface in contact with electrolyte to be heated.

Boiler electrodes commonly used in the prior art are made of sheet metals, such as mild steel or stainless steel, with a smooth surface typical for sheet metals after rolling or annealing. During operation with an alternating current flow, irreversible reactions occur between the electrolyte and the electrodes due to the varying electrode potential, which causes corrosion of the electrodes and contamination of the electrolyte. The corrosion and erosion of the electrodes is further enhanced by gas and steam bubble formation on the electrode surfaces. Corrosion shortens electrode life and causes accummulation of corrosion products in the circulating electrolyte solution. Furthermore, corrosion causes the formation of protrusions on the electrode surface. These conditions enhance the risk of arcing at the electrode surfaces, which further damages the electrodes.

Among the problems encountered by the prior art using sheet metal electrodes in an alternating current boiler are metal disolution and corrosion, hydrogen and oxygen evalution at higher current densities and partial discharge or arcing. Also, the prior art electrodes using steel sheets experience voltage excursions at the electrode surface which could approach two volts, thereby encountering the hydrogen evolution potential during each negative half-wave and the oxygen evolution potential during each positive half-wave of the voltage cycle. In the above-described efforts to use sheet metal electrodes, power reduction is required to limit the effects of these problems.

Accordingly, it is an object of the instant invention to provide a boiler electrode structure which avoids hydrogen evolution and oxygen evolution and allows high current density use without promoting corrosion and erosion of the electrode.

An additional object of the instant invention is to provide a method for producing an electrode having high current density capacity and low oxygen and hydrogen evolution characteristics.

SUMMARY OF THE INVENTION

A porous conductive substrate comprising a metal screen or perforated foil or porous sintered body is covered or impregnated with a microporous compound including a reversible electrode couple to produce a high surface area and high-capacity boiler electrode. The electrode is made by depositing an electrochemically active mass comprising a reversible electrode couple on a conductive substrate. One particular method includes plating a nickel layer on a mild steel screen or perforated foil substrate, sintering a porous layer of nickel particles onto the substrate and impregnating said sintered layer of particles by immersion in a solution of metal nitrate and subsequent reaction of the nitrate in concentrated aqueous alkali hydroxide solution to provide a porous layer of metal hydroxide. Other methods of producing a porous layer of metal hydroxide on a screen a porous substrate include pasting with a polymeric binder and electrodeposition.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

MANNER AND PROCESS OF MAKING AND USING THE INVENTION

Figure 1:
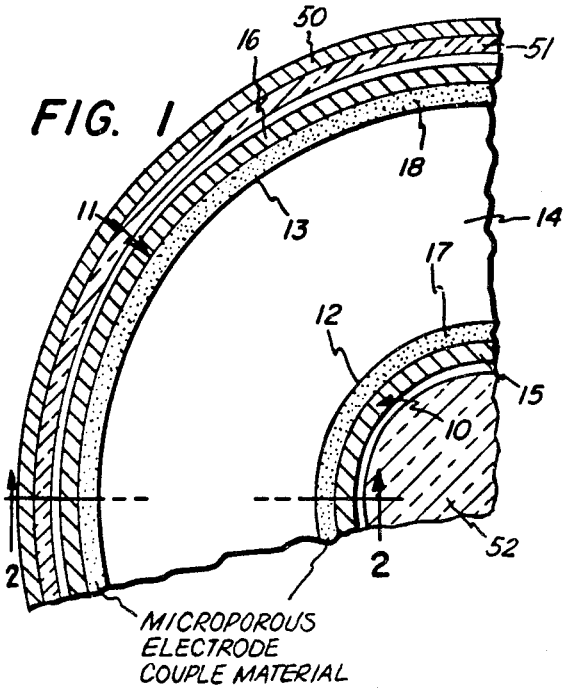
FIG. 1 is a schematic partial cross-sectional view of an electrode boiler of the type in which the instant invention would be employed.
Figure 2:
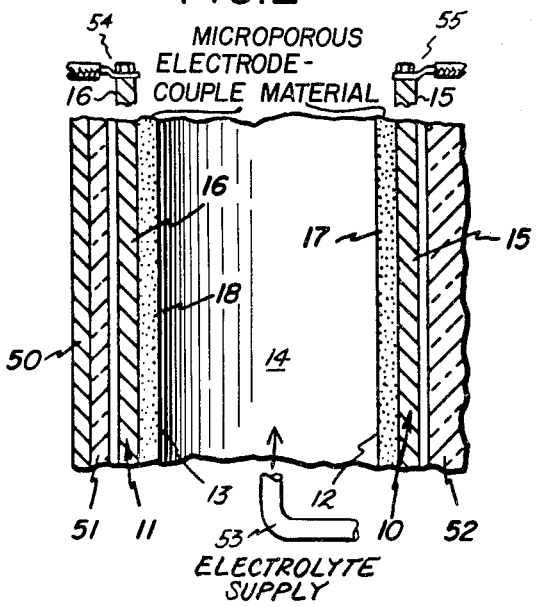
FIG. 2 is a schematic partial cross-sectional view of the boiler cell of FIG. 1 taken along line 2—2 of FIG. 1.

FIGS. 1 and 2 illustrate schematically an arrangement of electrodes as used in an electrode boiler. As shown in FIG. 2, a pressure vessel comprising, for example, a steel vessel 50 and glass liner 51 encloses the boiler electrodes 10 and 11 and an insert 52 of a glass, ceramic or other insulating material. Inner electrode 10 and outer electrode 11 are disposed with major surfaces 12 and 13, respectively, in juxtaposition and spaced from each other to define therebetween a space 14 to which an electrolyte to be heated is provided by conventional means 53. Electrical connection means (54, 55) is provided to electrodes 10 and 11 from a source of AC power (not shown). Electrodes 10 and 11 include layers 15, 16, respectively, of metallic material, preferably nickel or mild steel coated with nickel, and a porous layer 17, 18, respectively, of an electrode couple, i.e., a material which can be electrochemically reversibly oxidized and reduced in response to AC current flow therethrough.

Figure 3:
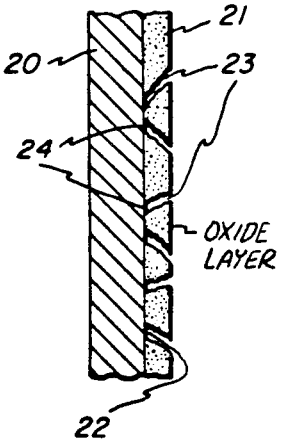
FIG. 3 PRIOR ART
FIG. 3 is an enlarged schematic cross-sectional view of a portion of an electrode of the prior art.
Figure 4:
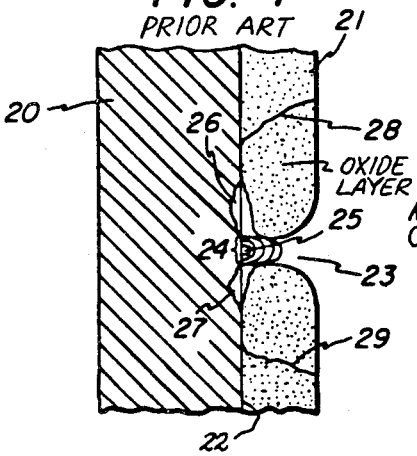
FIG. 4 PRIOR ART
FIG. 4 is a schematic further enlargement of a prior art electrode structure.

The prior art electrodes, as shown in FIGS. 3 and 4, utilized mild steel or stainless steel substrates 20 as the electrode. Such electrodes develop a coating layer 21 of oxide or hydroxide on the surface 22 of the electrode. During passage of each cycle of alternating electrical current through the electrode substrate 20 and an electrolyte disposed between electrodes, a portion of the substrate material would be oxidized during one half-cycle of current wave, but only partially reduced during the subsequent half-cycle of electrical current flow. The oxide layer 21 hence continues to grow during each subsequent cycle until cracks 23 develop in layer 21 due to a mismatch between the material densities of substrate 20 and oxide layer 21, causing oxide layer 21 to form blisters and spall from the surface 22 of substrate 20. Due to current concentrations at exposed locations 24, gas bubbles 25 are created where cracks 23 in coating layer 21 have occurred. The electrode substrate 20 and coating layer 21 are eroded as shown at 26 and 27 in FIG. 4, further loosening coating material 21 from substrate 20. Pieces of the coating layer 21 are then easily cracked as shown at 28 and 29 and broken off from the surface, and further corrosion of the substrate material ensues.

Figure 5:
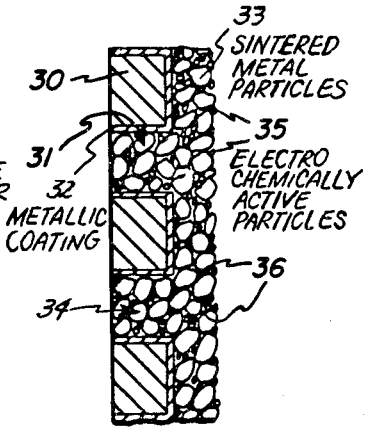
FIG. 5 is a schematic enlarged partial cross-sectional view of a boiler electrode of the instant invention.

In FIG. 5 is shown one preferred embodiment of my novel electrode structure. A perforated metallic substrate 30 (preferably made of mild steel) having openings 31, is coated with a layer 32 of nickel by electrodeposition or electroplating. Alternatively, the substrate may be made entirely of nickel, although such a construction would be more expensive. A mass of nickel particles 33 is then sintered onto the coated substrate, producing a mass of sintered nickel particles bonded to the nickel coating on the substrate. The assembly is then immersed in a nickel nitrate bath, and then the absorbed nitrate solution is precipitated to fine nickel hydroxide particles, $Ni(OH)_2$, by immersion in alkaline solution. The immersion steps may be repeated several times if desired to increase the amount of $Ni(OH)_2$ deposited. Alternatively, the $Ni(OH)_2$ may be deposited by electrodeposition into the sintered nickel mass or a $Ni(OH)_2$ paste containing a polymeric binder, such as polytetrafluoroethylene (Teflon) or a polyolefin binder, may be pasted onto the surfaces of a screen or perforated foil. A DC voltage is then applied to the electrode to partially charge the electrode thereby converting a portion of the $Ni(OH)_2$ to NiOOH, so that an active mass comprising the electrode couple $Ni(OH)_2$/NiOOH is formed on the electrode surface. As shown in FIG. 5, the above-described method of production produces an electrode having a layer 34 including an electrochemically active mass of particles 35 deposited in the voids 36 between sintered metallic particles 33.

In operation of the device as described, during one half-cycle of the alternating electrical current, nickel hydroxide within the active mass is converted from the reduced form, $Ni(OH)_2$, to the oxidized form, NiOOH, and in the subsequent half-cycle the reaction is reversed. By having at least some of each member of the electrode couple, $Ni(OH)_2$/NiOOH always present the electrochemically active mass continuously charges and discharges. Due to the high capacity of the active mass to store electrical charge, the reaction occurs essentially entirely in the active mass so that the potential during the negative half-wave of the voltage cycle does not reach the hydrogen generation potential and the potential during the positive half-wave of the voltage cycle does not reach the oxygen generation potential. Hence, corrosion and erosion of the electrode are avoided. Further, since the active mass is a microporous material, the contact surface area between the electrolyte and the surface of the active mass is large compared to the surface area of the electrode substrate 30. Therefore, the current density referred to the true surface area of the active particles in contact with the electrolyte is much reduced, the resistive heating of the electrode substrate is lowered, and the voltage excursions at the electrode surface are limited, so that the potentials for hydrogen generation and oxygen generation are avoided.

In a cylindrical cell employing my invention, the center electrode may comprise a solid steel or iron alloy rod (in which case insert 52, FIG. 2, would be omitted) or a hollow cylindrical mild steel or iron alloy tube having a radial thickness of about 0.1 to about 0.5 millimeter, and possibly smaller if small electrolytic cells are to be used, or if mechanical strength and current-carrying capacity do not require a 0.1 millimeter thick electrode. The outer electrode 11 may comprise a mild steel or iron alloy sheet having a thickness of about 0.2 to about 1.0 millimeter depending upon mechanical strength requirements and current-carrying capacity, and preferably would have a thickness of about 0.5 millimeter. If small electrolytic cells were intended, a thickness in the range of 0.2 millimeter may be adequate for the outer electrode substrate. Openings 31 in electrode substrate 30 would be typically 0.5 to 2.0 millimeters and preferably approximately 1.0 millimeter diameter. The nickel coating layer 32 on substrate 30 would have a thickness of about 0.0001 to about 0.10 millimeter and preferably about 0.005 millimeter. If a solid nickel substrate were to be used, the preferred thickness of the substrate would typically not exceed 0.5 millimeter due to the cost of nickel sheet. In a typical assembly, three pairs of concentric electrodes would be disposed within a single pressure vessel as shown in U.S. Patent application Ser. No. 32,116 of T. A. Keim, filed Apr. 23, 1979, now abandoned, assigned to the instant assignee, and incorporated herein by reference. Alternately, a plurality of small diameter electrodes could be disposed within a single large outer electrode within a pressure vessel. Other configurations, including flat plate electrodes, could advantageously be built accordingly to my invention.

Due to the high porosity electrode structure and high electrode surface area, the instant invention avoids the voltage excursions experienced by a mild steel sheet electrode. The electrode structure of the instant invention gives rise to very large pseudo-capacitances. The AC impedance of the electrodes is several orders of magnitude smaller than for sheet electrodes and is predominantly capacitive. The voltage excursions around the equilibrium potential are typically on the order of tens of millivolts rather than volts as are experienced with prior art sheet electrodes.

Figure 6:
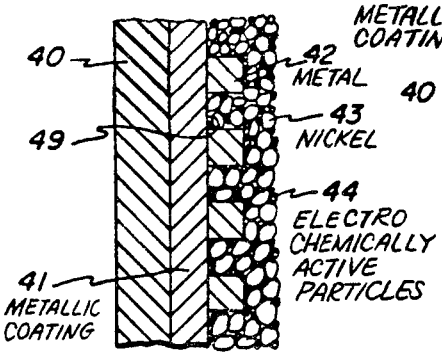
FIG. 6 is a schematic enlarged partial cross-sectional view of an alternative embodiment of the instant invention.

In FIG. 6 an alternative embodiment of my invention is shown which is intended to promote the adhesion of the active mass to the substrate. A solid sheet substrate 40 of mild steel is coated with a layer 41 (greatly enlarged) of nickel, and nickel protrusions 42 are attached to the coating layer 41, for example by welding, or they may be an integral part of the coating layer 41. Alternatively, a wire mesh screen of nickel could be used as an attachment to substrate 40 and nickel coating 41 to provide the projecting nickel protrusions 42 in a mesh form on the surface of the coating layer 41. The mesh screen could be titanium-brazed or otherwise bonded to nickel layer 41. As in the embodiment shown in FIG. 5, nickel particles 43 are sintered onto the nickel layer 41 and protrusions 42. The sintered mass is impregnated with nickel hydroxide particles 44 by immersion in a nickel nitrate bath depositing nitrate onto the surface of particles 43, followed by immersion in an alkaline bath to precipitate small particles 44 of nickel hydroxide, $Ni(OH)_2$, onto nickel particles 43. Again, this electrode is then preferably partially charged by connection to a DC electrical power source. This produces electrode couple $Ni(OH)_2$/NiOOH in solid solution.

The preferred thickness of substrate 40 is in the range of 0.1 mm to 1.0 mm and the thickness of the nickel coating 41 is in the range of 0.0001 to 0.10 mm. Protrusions 42, whether single members or a mesh, have a thickness in the range of 0.2 to 2.0 mm and the sintered mass has a thickness from the surface 49 of coating 41 of about 0.2 to about 4.0 mm. The protrusion thickness and sintered mass thickness are selected so that the protrusions 42 do not project beyond the outermost surface of the active mass.

Figure 7:
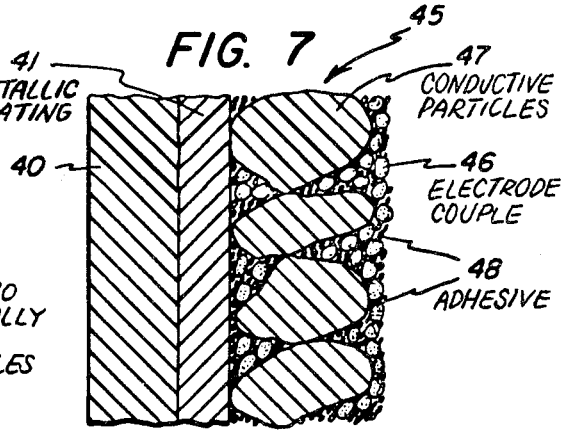
FIG. 7 is a schematic enlarged partial cross-sectional view of a further preferred embodiment of the instant invention.

In FIG. 7 a further preferred embodiment of my invention is shown greatly enlarged. A substrate 40 and nickel coating layer 41 similar to that in FIG. 6 is covered with a layer 45, including particles 46 of an electrode couple, and a mass of conducting particles 47, such as nickel or carbon powder, bonded to nickel layer 41 by an adhesive 48 or by impregnation of the particulate material with a polymeric binder, such as polytetrofluoroethylene or polyolefins.

Figure 8:
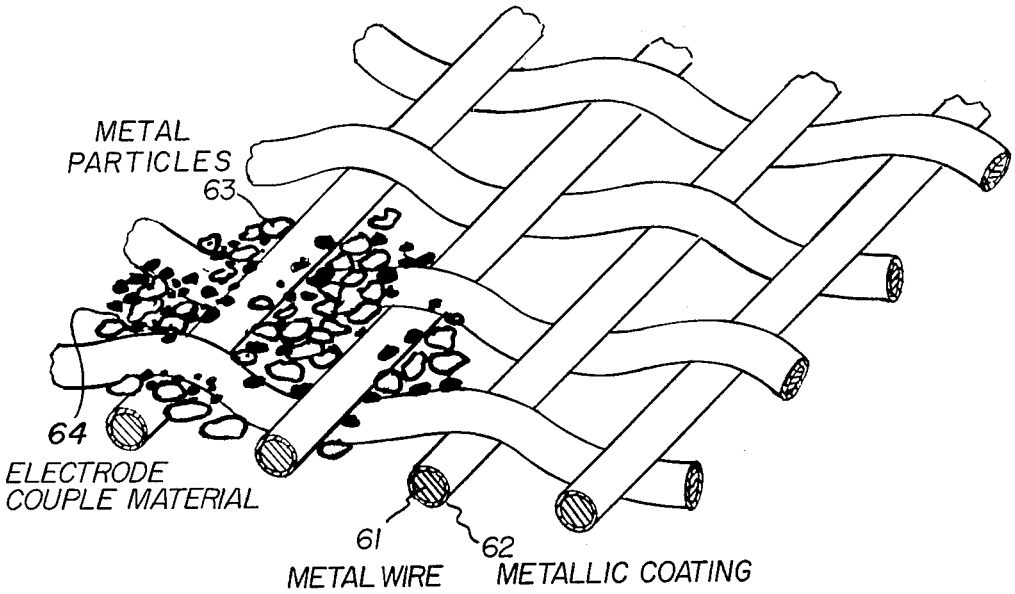
FIG. 8 is a schematic partial pictorial view of an alternative embodiment of the instant invention.

An alternative substrate, FIG. 8, incorporates a mild steel mesh screen 61 which is coated with a nickel layer 62 to form a porous metal substrate. Alternatively, a mesh screen made entirely of nickel could be used. Nickel particles 63 are bonded onto the mesh by sintering or pasting with a mixture of particles and a polymeric binder, and the nickel screen and particle mass are subsequently treated as described above to provide the impregnation with an electrode couple 64.

Figure 9:
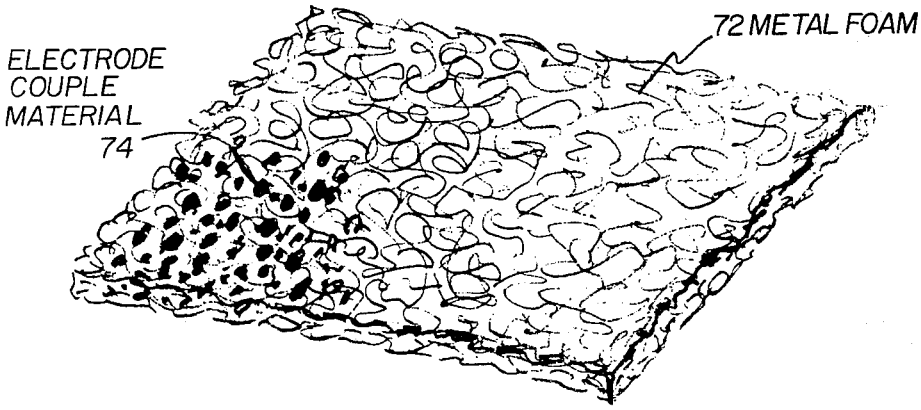
FIG. 9 is a schematic partial pictorial view of yet another alternative embodiment of the instant invention.

The substrate may also be manufactured as a nickel foam 72, as shown in FIG. 9. having a void volume in the range of approximately 90% to approximately 98%. The foam substrate is then impregnated with a $Ni(OH)_2$-/NiOOH electrode couple 74. A further alternative for forming a porous nickel surface to promote adhesion of the active mass would be by photoetching a smooth layer of nickel into a desired pattern, such as that of the protrusions shown in FIG. 6. In either case, the thickness of the porous nickel material would be approximately 0.2 to 2.0 millimeters, and a sintered mass of nickel particles would be sintered to the etched nickel layer.

A further alternative embodiment includes cladding a mild steel substrate with a nickel foil, pasting a mixture of nickel hydroxide, polymeric binder and leachable pore former onto the surface of the clad nickel foil, and placing the electrode in a bath to dissolve the pore former to produce a porous mass of powder and hydroxide on the surface of the electrode. The electrode is then connected to a DC source to partially charge the electrode to produce the desired electrode couple.

The embodiments described above employing a nickel powder sinter have the favorable characteristic of long life and high current-carrying capacity, but are more expensive to manufacture than the embodiments employing an active mass bonded to the substrate by polymeric binders, which can be employed for lower current applications. For boiler applications in which an alkaline solution (pH above 7) is to be used the following alternative combinations may be employed using any of the above-described electrode structures of my invention. A manganese hydroxide electrode couple, the reduced form, $Mn(OH)_2$, and the oxidized form, $Mn(OH)_3$ bonded to a nickel or nickel coated electrode may be used. An iron hydroxide couple, $Fe(OH)_2$-/$Fe(OH)_3$, bonded to an iron alloy substrate or to a nickel or nickel coated electrode may be employed. In a specific embodiment, the electrode structure comprises a porous mild steel sheet substrate with a layer of iron particles bonded together and bonded to the substrate, and the electrode couple disposed substantially within the porous layer of bonded iron particles comprises $Fe(OH)_2/Fe(OH)_3$. Among other electrode couples useful as active masses with the nickel or nickel coated electrodes are the following: silver oxides, $Ag_2O/AgO$; silver/silver oxide, Ag/AgO; mercury/mercury oxide, Hg/HgO and cadmium/cadmium hydroxide, $Cd/Cd(OH)_2$. A porous copper, aluminum or silver substrate may be used with an active mass of $Ag_2O/AgO$, Ag/AgO, or $CuO/Cu(OH)_2$. In a specific embodiment the electrode structure comprises a porous sheet of copper, a porous layer of copper particles bonded together and bonded to the porous sheet of copper, and the electrode couple disposed substantially within the porous layer of bonded copper particles comprises $CuO/Cu(OH_2)$. In another specific embodiment, the electrode structure comprises a porous sheet of silver, a porous layer of copper particles bonded together and bonded to the porous sheet of silver, and the electrode couple comprises $CuO/Cu(OH)_2$. These electrode couples have favorable electrical properties, but are not generally preferred due to their toxic nature and high cost.

When acidic (pH below 7) solution electrolytes are to be used, lead, leadsulfate electrode couples, $Pb/PbSO_4$, or a lead sulfate/lead dioxide electrode couple a $PbSO_4/PbO_2$, bonded to a lead or porous lead substrate may be preferred. With these electrode couples the nickel or nickel coated substrate will not be used.

In operation, the porous electrodes and microporous electrode couples described exhibit a large pseudocapacitance, so that the AC impedance of the electrodes is small and the voltage excursions around the equilibrium potential are maintained within millivolts of equilibrium. With a proper choice of a reversible active material for the electrode couple compatible with the electrolyte to be used, the oxygen and hydrogen generating potentials are not approached. Therefore, oxygen and hydrogen generation are avoided, and the risk of explosion is eliminated. Further, the deterioration of the electrode is prevented, since essentially only the reversible active mass of the electrode couple conducts the current into the electrolyte to be heated. The reversible electrochemical reaction also prevents corrosion of the electrodes and accumulation of corrosion products within the electrolyte. This reduction of corrosion extends electrode life by a factor of from about 3 to 10 times. The elimination of corrosion products from the electrolyte and the elimination of the production of points projecting from the electrode surface also reduce the risk of arcing.

In an experimental demonstration of my invention, a nickel hydroxide electrode couple, $Ni(OH)_2$/NiOOH, bonded to substrates was used in an electrode cell, and the results obtained were compared with those obtained using smooth mild steel sheet electrodes under identical conditions. Electrical power at 120 volts AC was applied to the cell filled with water containing 0.05 mols per liter sodium sulfate, $Na_2SO_3$. The electrode potential was measured oscillographically. With a current density of 0.10 amps per square centimeter, which is typical for boiler applications, no oxygen, $O_2$, was evolved for the fully discharged electrode (i.e., all hydroxide in the reduced form, $Ni(OH)_2$), no hydrogen, $H_2$ was evolved for a fully charged electrode (i.e., all hydroxide in the oxidized form, NiOOH), and neither $H_2$ nor $O_2$ were formed on an approximately half-discharged electrode (i.e., approximately balanced concentrations of $Ni(OH)_2$ and NiOOH). None of these electrodes showed signs of erosion of the nickel hydroxide. The voltage excursions at the electrode surface were limited to a few tens of millivolts. By contrast, the mild steel sheet electrode evolved hydrogen and oxygen, showed severe signs of scale formation and corrosion, and exhibited voltage excursions of approximately 2 volts. Consequently, it is readily apparent to those skilled in the art that my novel electrode structure including an electrode couple active mass layer represents a clear improvement of electrodes for use in electrode boilers.

Best Mode

I contemplate as the best mode of practicing my invention utilizing a porous metallic substrate of mild steel as shown in FIG. 5 coated with an electroplated coating of nickel having a sintered mass of nickel powder affixed thereto by sintering. The preferred impregnation technique is immersion in a nickel nitrate bath and subsequent conversion to nickel hydroxide by immersion in an alkaline solution and repeating these immersion steps several times to deposit a $Ni(OH)_2$/NiOOH electrode couple within the sintered mass.

The above describes a novel boiler electrode and a method of making it. The resultant electrode provides long life and usability with readily available electrolytes.

I claim:

1. An electrode boiler containing an aqueous electrolyte and a pair of spaced electrodes connected to an AC power source and separated by said aqueous electrolyte, each said electrode comprising:

an electrically conductive metal substrate; and a microporous electrochemically active mass comprising a reversible electrode couple adhering to one face of said substrate covering substantially the entire said face of said substrate and being present in such quantity that at least some of each member of said electrode couple is present at all times during use, said electrodes being disposed with said active masses facing each other and in contact with said electrolyte, said electrode couple consisting essentially of a material which is electrochemically reversibly oxidized and reduced in response to AC current flow therethrough from one electrode to the other allowing high current density use without promoting corrosion and erosion of the electrodes.

2. The electrode boiler of claim 1 wherein each said electrode includes a porous layer of metallic powder particles bonded together and bonded to said one face of said substrate, and said electrochemically active mass comprising said electrode couple is disposed substantially within said porous layer of bonded metallic particles.

3. The electrode boiler of claim 2 wherein said porous layer is comprised of sintered nickel powder and said electrode couple is comprised of $Ni(OH)_2$/NiOOH.

4. The electrode boiler of claim 3 wherein said substrate comprises a mild steel mesh screen coated with a layer of nickel.

5. The electrode boiler of claim 2 wherein said electrode couple is bonded to said porous layer with a polymeric binder.

6. The electrode boiler of claim 2 wherein said metallic powder particles are nickel powder and said electrode couple is selected from the group consisting of: $Mn(OH)_2/Mn(OH)_3$, $Ag_2O/AgO$, Hg/HgO, $Cd/Cd(OH)_2$, Ag/AgO and $Ni(OH)_2$/NiOOH.

7. The electrode boiler of claim 2 wherein said substrate comprises a porous mild steel sheet, said metallic particles are iron particles and said electrode couple comprises $Fe(OH)_2/Fe(OH)_3$.

8. The electrode boiler of claim 2 wherein said substrate is a porous sheet of copper, said metallic particles are copper particles, and said electrode couple comprises $CuO/Cu(OH)_2$.

9. The electrode boiler of claim 2 wherein said substrate is a porous sheet of silver, said metallic particles are copper particles and said electrode couple comprises $CuO/Cu(OH)_2$.

10. The electrode boiler of claim 1 wherein said substrate comprises a porous nickel screen and said electrode couple comprises $Ni(OH)_2$/NiOOH adhered to said screen.

11. The electrode boiler of claim 1 wherein said substrate is a porous sheet of lead, and said electrode couple is selected from the group consisting of $Pb/PbSO_4$ and $PbSO_4/PbO_2$.

12. The electrode boiler of claim 1 wherein the substrate is a sheet of nickel foam having a void volume up to approximately 98%; and said electrode couple also being disposed within said substrate and comprising a couple selected from the group consisting of: $Ni(OH)_2$/NiOOH, $Mn(OH)_2/Mn(OH)_3$, $Ag_2O/AgO$, Hg/HgO, $Cd/Cd(OH)_2$, and Ag/AgO.

13. An electrode boiler comprising:

a cylindrical pressure vessel comprising a metal cylinder having a cylindrical nonconductive liner disposed within said cylinder contiguous with the inner cylindrical surface thereof;

a first generally cylindrical electrode disposed within said vessel generally concentric thereto and adjacent and spaced from said liner;

a second generally cylindrical electrode disposed within and generally concentric with said first electrode and spaced therefrom; a generally cylindrical insulator disposed generally concentrically with and within said second electrode;

said first and second generally cylindrical electrodes each comprising:

a cylindrical electrically conductive metal substrate;

a porous layer of metallic powder particles bonded together and bonded to one face of said substrate covering substantially the entire said face of said substrate; and a microporous electrochemically active mass comprising a reversible electrode couple disposed substantially within said porous layer and being present in such quantity that at least some of each member of said electrode couple is present at all times during use; said electrode couple consisting essentially of a material which is electrochemically reversibly oxidized and reduced in response to AC current flow therethrough allowing high current density use without promoting corrosion and erosion of the electrodes; said electrodes being disposed to have said layers facing each other;

means connecting said first and second electrodes to a source of alternating current electrical power; and means for supplying aqueous electrolyte to the interior of said pressure vessel to the space between said electrodes.

14. The apparatus of claim 13 wherein said substrate of each electrode comprises a porous mild steel sheet coated with a layer of nickel having a thickness of at least about 0.001 millimeter, said porous layer of metallic powder particles comprises a sintered mass of nickel powder particles sintered to said nickel layer, and said electrode couple is selected from the group consisting of $Ni(OH)_2/NiOOH$, $Mn(OH)_2/Mn(OH)_3$, $Ag_2O/AgO$, Ag/AgO, Hg/HgO and $Cd/Cd(OH)_2$.

15. The apparatus of claim 13 wherein said substrate comprises a porous nickel screen, said porous layer of metallic powder particles comprises a sintered mass of nickel powder particles sintered to said nickel screen, and said electrode couple is selected from the group consisting of $Ni(OH)_2/NiOOH$, $Mn(OH)_2/Mn(OH)_3$, $Ag_2O/AgO$, Hg/HgO, Ag/AgO and $Cd/Cd(OH)_2$.

16. The apparatus of claim 13 wherein said substrate comprises a mild steel sheet having a coating layer of nickel and a plurality of protrusions made of nickel extending generally perpendicularly from the surface of said layer of nickel and bonded thereto, said porous layer of metallic powder particles comprises a sintered mass of nickel powder sintered to said nickel protrusions as well as those portions of said nickel layer not bonded to said protrusions and said electrode couple is selected from the group consisting of $Ni(OH)_2/NiOOH$, $Mn(OH)_2/Mn(OH)_3$, $Ag_2O/AgO$, Ag/AgO, Hg/HgO and $Cd/Cd(OH)_2$.

* * * * *